US007254356B2

(12) United States Patent
Tomine et al.

(10) Patent No.: US 7,254,356 B2
(45) Date of Patent: Aug. 7, 2007

(54) IMAGE FORMING APPARATUS

(75) Inventors: Jun Tomine, Abiko (JP); Yuichi Ikeda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 171 days.

(21) Appl. No.: 11/228,318

(22) Filed: Sep. 19, 2005

(65) Prior Publication Data

US 2006/0078349 A1 Apr. 13, 2006

(30) Foreign Application Priority Data

Oct. 7, 2004 (JP) ..... 2004-294622

(51) Int. Cl.
*G03G 15/16* (2006.01)

(52) U.S. Cl. ..... 399/101

(58) Field of Classification Search ..... 399/101, 399/343, 350, 351

See application file for complete search history.

(56) References Cited

U.S. PATENT DOCUMENTS 4,334,766 A * 6/1982 Sugiyama et al. ..... 399/351
4,498,760 A * 2/1985 Sugiyama ..... 399/351
4,827,311 A * 5/1989 Bothner et al.
5,196,893 A * 3/1993 Nishise et al. ..... 399/343
5,241,350 A * 8/1993 Bigelow ..... 399/351
2004/0022554 A1* 2/2004 Fina et al. ..... 399/350

FOREIGN PATENT DOCUMENTS

| | | |
|---|---|---|
| JP | 11-119620 | 4/1999 |
| JP | 11-272124 | 10/1999 |
| JP | 2003-345096 | 12/2003 |
| JP | 2004-126122 | 4/2004 |

* cited by examiner

*Primary Examiner*—Susan Lee
(74) *Attorney, Agent, or Firm*—Fitzpatrick, Cella, Harper & Scinto

(57) ABSTRACT

An image forming apparatus includes: a belt member for bearing and moving a toner image; a tension roller for supporting the belt member and imparting tension to the belt member; a transferring device for transferring the toner image borne by the belt member to a recording material; a blade member which is in contact with a portion of the belt member supported by the tension roller to be at an acute angle on a downstream side with respect to a moving direction of the belt member and which removes toner on the belt member; a supporting member for supporting the blade member; a fixing member which fixes on the supporting member a substantial central portion of the blade member in a direction perpendicular to the moving direction of the belt member so that the blade member is rotatable; and a cushion member which is disposed between the fixing member and the blade member and which is deformed to urge the blade member, wherein the cushion member is disposed on a side opposite to the belt member with respect to the blade member.

3 Claims, 7 Drawing Sheets

IMAGE FORMING APPARATUS

BACKGROUND OF THE INVENTION

1. Field of the Invention

The present invention relates to an image forming apparatus equipped with a cleaning device which cleans an endless belt by a blade cleaning system.

2. Related Background Art

Conventionally, as an image forming apparatus, such as a copying machine or a laser beam printer, there has been known a color image forming apparatus adopting a system in which: a toner image formed on an image bearing member, such as a photosensitive drum, is transferred a plurality of times to an intermediate transfer member to form a full color image; and this full color image is then collectively transferred to a recording material, such as paper. Above all, there is widely known a system which is equipped with a plurality of image bearing members for forming toner images of different colors and an intermediate transfer belt in the form of an endless belt constituting the intermediate transfer member and in which this intermediate transfer belt is held in contact with the image bearing members to effect a primary transfer of the toner images of a plurality of colors to the intermediate transfer belt in a superimposing fashion before collectively effecting a secondary transfer of the toner images from the intermediate transfer belt to the recording material.

Incidentally, in a color image forming apparatus using such an intermediate transfer belt, it is necessary to remove toner remaining on the intermediate transfer belt after the secondary transfer of the toner images from the intermediate transfer belt to the recording material. As a cleaning system, a fur brush cleaning system, a blade cleaning system, etc. are available. Of those, a blade cleaning system which uses a plate-like cleaning blade of urethane rubber is widely used because of its simple construction and high cleaning effect. Of those blade cleaning systems, due to its satisfactory cleaning performance, a so-called counter abutment system is in frequent use, in which abutment of the forward end of the cleaning blade is effected in an inclined state such that a downstream side portion of the cleaning blade is at an acute angle with respect to the running direction of the intermediate transfer belt.

It should be noted, however, that, to drive the intermediate transfer belt, it is necessary to use at least a driving roller for transmitting the driving force from the motor to the intermediate transfer belt, and a tension roller for maintaining the requisite tension of the intermediate transfer belt. The intermediate transfer belt is under the largest load where it is in contact with the image bearing members, so it is necessary to arrange the driving roller on the downstream side of the portion where the intermediate transfer belt is in contact with the image bearing members. For, if the driving roller is arranged on the upstream side of the portion where the intermediate transfer belt is in contact with the image bearing members, deflection is likely to be generated in the intermediate transfer belt, and it is necessary to impart a larger tension to the intermediate transfer belt, with the result that the intermediate transfer belt suffers greater damage. Thus, the tension roller is arranged on an upstream side of the portion where the intermediate transfer belt is brought into contact with the image bearing members, and the cleaning device for cleaning the intermediate transfer belt is arranged so as to be opposed to and in contact with the tension roller.

Incidentally, the tension roller serves to impart a fixed tension to the intermediate transfer belt. Thus, the tension roller supports the intermediate transfer belt with a fixed load by urging means, such as a spring. That is, the tension roller is not fixed in position with respect to the apparatus main body, and is under the influence of the peripheral length and unevenness in thickness of the intermediate transfer belt, eccentricity of the tension roller itself and other rollers (e.g., the driving roller), etc., with its position undergoing change every moment. In the case in which the cleaning device adopts the blade cleaning system, inaccuracy in the position of the tension roller, which thus constitutes an opposing roller, leads to a very serious disadvantage.

While the blade cleaning system is an effective system unsurpassed in performance under optimum setting by any other cleaning system, it may often have some adverse effects. For example, when the abutment pressure is too high, the cleaning blade is likely to undergo flutter. Thus, in this system, the permissible range for the abutment pressure of the cleaning blade i.e. the permissible setting range of abutment pressure tends to be smaller as compared with that of other cleaning systems, e.g., the one utilizing a fur brush. Thus, when a roller which undergoes positional fluctuation like the tension roller is used as the opposing roller, it is rather difficult to adopt the blade cleaning system.

If, as means for solving this problem, a construction were adopted in which the cleaning blade is caused to abut the intermediate cleaning blade with a fixed pressure, the blade cleaning system could be adopted relatively easily.

However, for example, when there is a difference in peripheral length between the depth side and the front side of the intermediate transfer belt, the axis of the tension roller is inclined, resulting in generation of generatrix misalignment between the tension roller and the cleaning blade. In particular, use of an intermediate transfer belt whose peripheral length is almost 2 m, the difference in peripheral length between the right and left ends of the intermediate transfer belt is approximately 2 mm at maximum. When such an intermediate transfer belt is used, a positional misalignment of approximately 1 mm at maximum is generated between the right and left sides of the tension roller, causing a generatrix misalignment that is not negligible between the tension roller and the cleaning blade. As a result, the cleaning blade makes unsymmetrical abutment, so that a difference in pressure is generated between the depth side and the front side of the cleaning blade, resulting in unsatisfactory cleaning. As an effective method for solving this problem, there has been conventionally known an effective method in which the cleaning member is provided with an equalizing mechanism, thereby reducing the difference in pressure between the depth side and the front side of the cleaning blade. To realize such a method, a cleaning blade equalizing system has been conceived. In this system, the frictional action of the cleaning blade is always balanced on both sides of an equalizing rotation shaft, so it is possible to apply a blade pressure uniform in the width direction of the image bearing members, making it possible to achieve a satisfactory cleaning performance.

However, once the abutting portion of the cleaning blade is drawn in, the abutment pressure at the portion drawn in becomes larger than that in the other portion, so that the cleaning blade is gradually drawn in, until a wire edge phenomenon occurs to the cleaning blade.

SUMMARY OF THE INVENTION

The present invention has been made in view of the above problem in the conventional art. It is an object of the present invention to provide an image forming apparatus equipped with a cleaning device capable of suppressing occurrence of a wire edge phenomenon to the cleaning blade, making it possible to maintain a satisfactory cleaning performance in a stable manner.

Another object of the present invention is to provide an image forming apparatus including: a belt member for bearing and moving a toner image; a tension roller for supporting the belt member and imparting tension to the belt member; a transferring means for transferring the toner image borne by the belt member to a recording material; a blade member which is in contact with a portion of the belt member supported by the tension roller to be at an acute angle on a downstream side with respect to a moving direction of the belt member and which removes toner on the belt member; a supporting member for supporting the blade member; a fixing member which fixes on the supporting member a substantial central portion of the blade member in a direction perpendicular to the moving direction of the belt member so that the blade member is rotatable; and a cushion member which is disposed between the fixing member and the blade member and which is deformed to urge the blade member, wherein the cushion member is disposed on a side opposite to the belt member with respect to the blade member.

DESCRIPTION OF THE PREFERRED EMBODIMENTS

In the present invention, even when the pressurizing force applied to the endless belt increases as a result of the forward end portion of the blade member being partially or entirely drawn in, it is possible for the blade member to be regulated in the movement in the direction to promote the wire edge phenomenon to the cleaning blade. Thus, the occurrence of a wire edge phenomenon to the blade member is suppressed, and the blade member can maintain a satisfactory cleaning performance in a stable manner.

In the following, embodiments of the present invention will be described in detail.

Embodiments of the present invention will be described with reference to the accompanying drawings.

Embodiment 1

First, the general construction of an image forming apparatus according to the present invention will be described with reference to FIG. 1.

Figure 1:
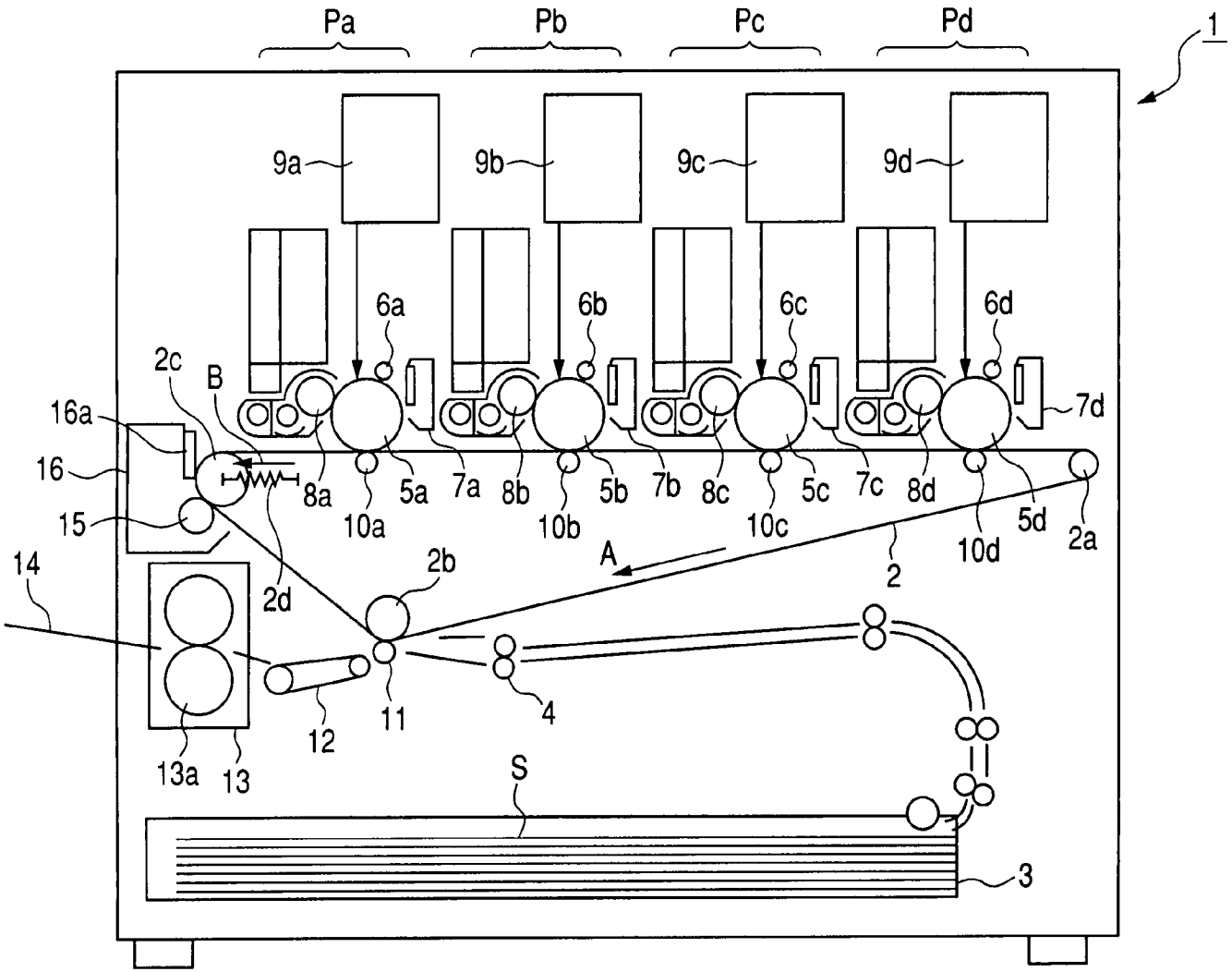
FIG. 1 is a longitudinal sectional view of an image forming apparatus according to Embodiment 1 of the present invention.

FIG. 1 is a longitudinal sectional view of an image forming apparatus 1. The image forming apparatus 1 is a four-color/full-color image forming apparatus adopting the electrophotographic process, and is adapted to form a full color image on a recording material by using a plurality of photosensitive drums 5 (5*a*, 5*b*, 5*c*, and 5*d*) serving as image bearing members.

Inside the image forming apparatus 1, there is arranged an intermediate transfer belt 2 that runs in the direction indicated by the arrow A. The intermediate transfer belt 2 is formed as an endless belt of a dielectric resin material, such as polycarbonate, polyethylene terephthalate resin film, or polyvinylidene fluoride resin film, and is stretched by a driving roller 2*a*, a secondary transfer inner roller 2*b*, and a tension roller 2*c*.

In the intermediate transfer belt 2, the load is maximum in the portion thereof that is in contact with the photosensitive drums 5 (5*a* through 5*d*), so it is necessary to arrange the driving roller 2*a* on the downstream side of the portion in contact with the photosensitive drums 5 (5*a* through 5*d*). For, if the driving roller 2*a* is arranged on the upstream side of the portion in contact with the photosensitive drums 5 (5*a* through 5*d*), deflection is likely to be generated in the intermediate transfer belt 2, and a larger tension must be imparted to the intermediate transfer belt 2, resulting in a greater damage to the intermediate transfer belt 2. Thus, the tension roller 2*c* is arranged on the upstream side of the portion in contact with the photosensitive drums 5 (5*a* through 5*d*), and a blade member 16 for cleaning the intermediate transfer belt 2 is arranged so as to be opposed to and in contact with the tension roller 2*c*.

The tension roller 2*c* is formed as a cylinder with a diameter of approximately ø22.6 to 60 mm, and its both end portions are pressurized in the direction indicated by the arrow B by springs 2*d* serving as urging means, imparting a predetermined tension to the intermediate transfer belt 2. Here, the pressurizing force applied to the tension roller 2*c* is approximately 2 kg on one side, imparting an appropriate tension to the intermediate transfer belt 2.

The springs 2*d* are disposed in the vicinities of the opposed ends of the tension roller 2*c*, respectively. The two springs 2*d* can pressurize the tension roller 2*c* independently from each other. Therefore, when there is a difference in peripheral length between the depth side and the front side of the intermediate transfer belt 2, the axis of the tension roller 2*c* may be inclined. In other words, the rotational axis of the tension roller 2*c* may be inclined with respect to the rotation axis of the intermediate transfer belt 2.

Above the intermediate transfer belt 2, four image forming portions Pa, Pb, Pc, and Pd of the same construction are arranged in series. Next, the construction of the image forming portion Pa will be described.

The image forming portion Pa is equipped with a photosensitive drum 5*a*, which is a drum-shaped image bearing member arranged rotatably. Around the photosensitive drum 5*a*, there are arranged processing devices, such as a primary charger 6*a*, a developing device 7*a*, and a cleaner 8*a*. The other image forming portions Pb, Pc, and Pd are of the same construction as the image forming portion Pa, and processing devices, such as primary chargers 6*b*, 6*c*, and 6*d*, developing devices 7*b*, 7*c*, and 7*d*, and cleaners 8*b*, 8*c*, and 8*d*, are respectively arranged around the photosensitive drums 5*b*, 5*c*, and 5*d*.

The developing devices 7*a*, 7*b*, 7*c*, and 7*d* arranged in the image forming portions Pa, Pb, PC, and Pd respectively accommodate magenta, cyan, yellow, and black toners, and the image forming portions Pa through Pd form toner images of the respective colors.

First, in the image forming portion Pa, an image signal corresponding to the magenta component color is applied onto the photosensitive drum 5*a* from optical means 9*a* to form an electrostatic latent image on the photosensitive drum 5*a*, and magenta toner is supplied to this electrostatic latent image from the developing device 7*a* to thereby form a magenta toner image. When, with the rotation of the photosensitive drum 5*a*, this magenta toner image reaches a transfer position where the photosensitive drum 5*a* and the intermediate transfer belt 2 are in contact with each other, the magenta toner image is transferred onto the intermediate transfer belt 2 by a primary transfer roller 10*a*. Similarly, the toner images of different colors formed in the image forming portions Pb through Pd are respectively transferred to the intermediate transfer belt 2 in a superimposing fashion.

On the other hand, a recording material S extracted from a feed cassette 3 is conveyed to the intermediate transfer belt 2 by way of a registration roller pair 4. Then, the recording material S is conveyed from the registration roller pair 4 to the nip between the secondary transfer inner roller 2*b* of the intermediate transfer belt 2 and a secondary transfer roller 11 adapted to come into and out of contact with the secondary transfer inner roller 2*b*, and the toner images on the intermediate transfer belt 2 are collectively transferred to the recording material S. Thereafter, the recording material S is conveyed to a fixing portion 13 by a conveying belt 12, and the toner images are fixed thereto by heat and pressure in the fixing portion 13. To enhance the releasing property of the recording material S and a fixing roller 13*a*, the fixing portion 13 has a mechanism for coating the surface of the fixing roller 13*a* with a releasing oil (e.g., silicone oil), and this oil also adheres to the recording material S.

The recording material S with the toner images fixed thereto is discharged onto a discharge tray 14. When two-side image formation is to be conducted automatically, the recording material passes through a recording material reverse path (not shown) and is fed again to the image forming portions Pa through Pd.

Thereafter, toner remaining on the photosensitive drums 5*a* through 5*d* is removed by cleaners 8*a* through 8*d*, and residual charge is removed from the photosensitive drums 5*a* through 5*d* by pre-exposure means (not shown) to make the photosensitive drums ready for next image formation. On the downstream side of the secondary transfer position of the intermediate transfer belt 2, there are arranged a charge-elimination/charging device 15 and a blade member 16, and toner, etc. adhering to the intermediate transfer belt 2 is removed by the blade member 16.

Figure 2:
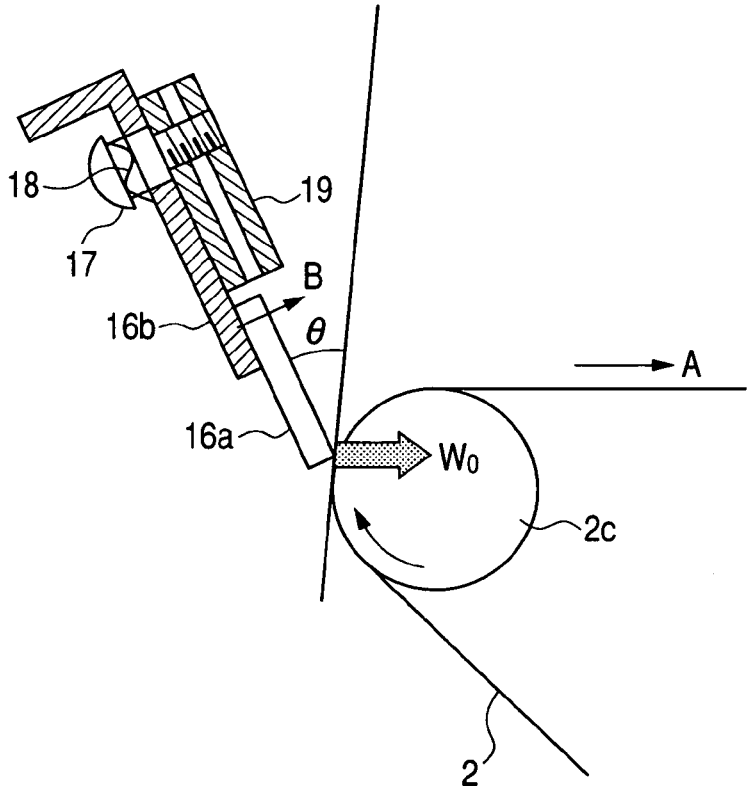
FIG. 2 is a diagram showing a construction of a cleaning blade of a cleaning device according to Embodiment 1 of the present invention.

Incidentally, as shown in FIG. 2, the blade portion 16*a* of the blade member 16 is formed of an elastic material. The blade portion 16*a* abuts the tension roller 2*c* through the intermediation of the intermediate transfer belt 2 and is pressurized by urging means (not shown), with its forward end portion being inclined so as to be at an acute angle on the downstream side with respect to the running direction (indicated by the arrow A) of the intermediate transfer belt 2. Further, the blade member 16 is rotatably supported substantially at the central portion with respect to the width direction of the intermediate transfer belt 2, and has an equalizing mechanism. The blade member 16 is rotatably supported substantially at the central portion with respect to the width direction of the intermediate transfer belt 2 by a shoulder screw (fixing member) 17 described below.

Here, the length of the blade member 16 in the longitudinal direction (the direction perpendicular to the moving direction of the intermediate transfer belt) is 326 mm. The above expression "supported substantially at the central portion" means that the central position of the shoulder screw 17 on the blade member 16 is ±20 mm with respect to the central position of the blade member 16 in the direction perpendicular to the moving direction of the intermediate transfer belt.

Next, the cleaning device, which is composed of the blade member 16, the shoulder screw 17, a spring washer 18, and a supporting member 19, will be described in detail with reference to FIGS. 2 through 5.

Figure 3:
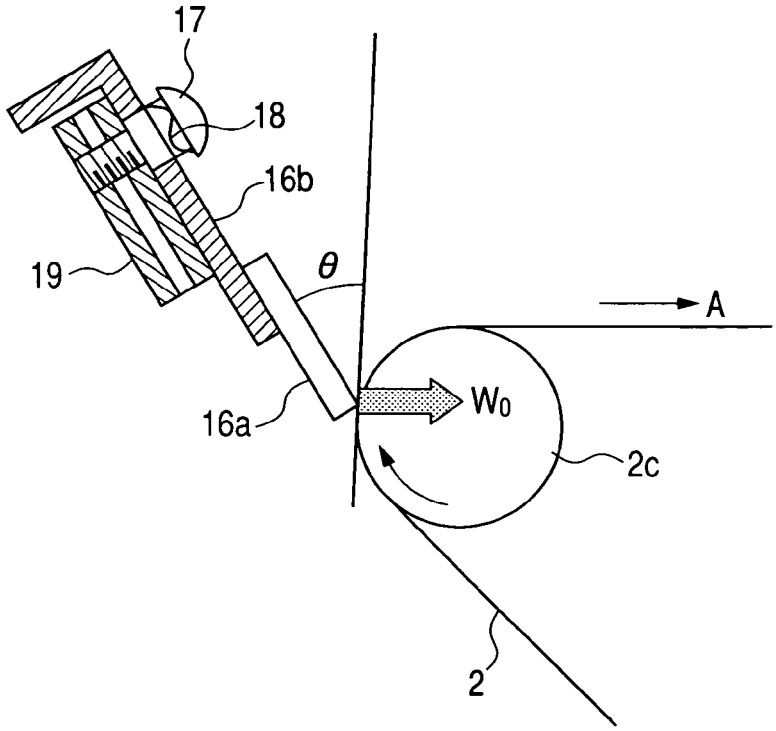
FIG. 3 is a diagram showing a construction of a cleaning blade of a cleaning device according to a comparative example.
Figure 4:
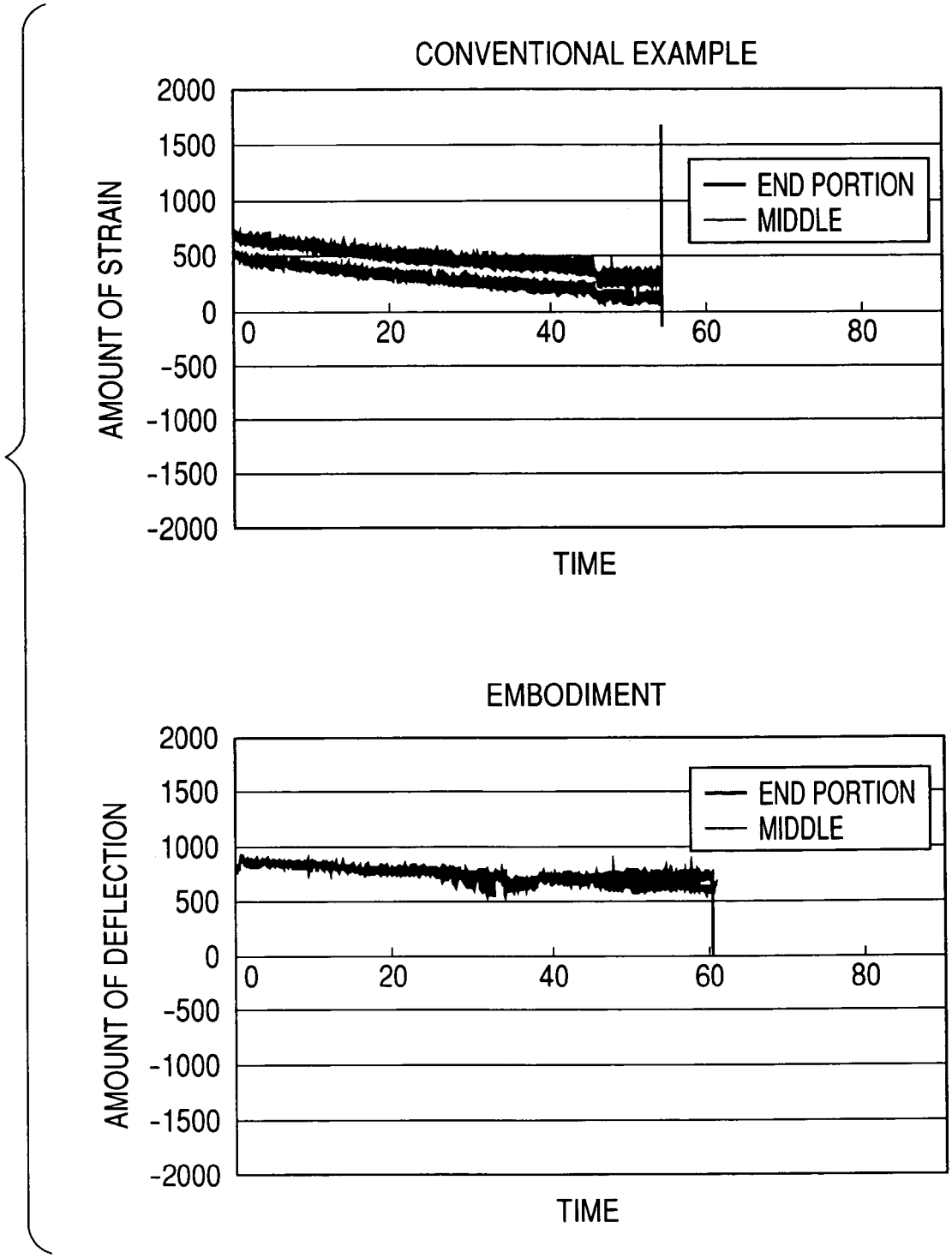
FIG. 4 is a diagram showing changes in an amount of deflection of the cleaning blade with time.
Figure 5:
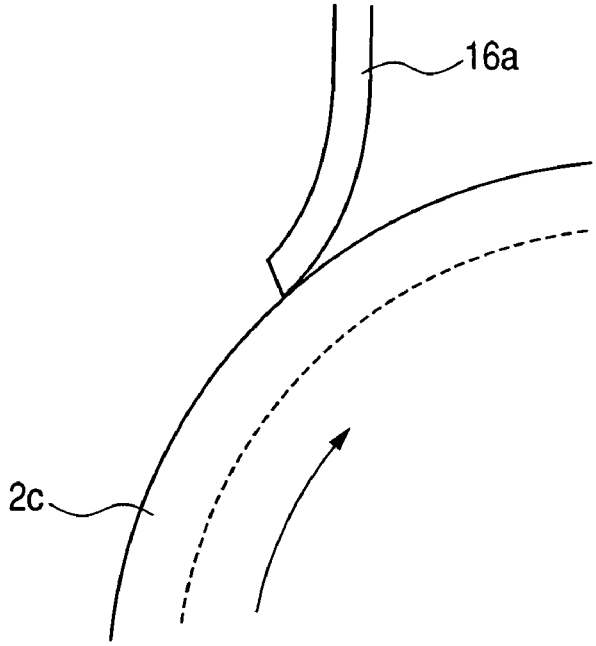
FIG. 5 is a diagram showing how a portion near the abutting portion of a cleaning blade is changed.

FIG. 2 is a diagram showing a construction of a cleaning device, FIG. 3 is a diagram showing the construction of a cleaning device according to a comparative example, FIG. 4 is a diagram showing the changes in amount of deflection with time of the blade portion 16*a* of the blade member 16, and FIG. 5 is a diagram showing how the portion near the abutting portion of the blade portion 16*a* is changed.

As shown in FIG. 2, in the blade member 16 of this embodiment, the blade portion 16*a* is urged by urging means (not shown) to abut the tension roller 2*c* with a pressurizing force W0 at an inclination angle θ.

Here, the blade portion 16*a* is mounted to an end portion of a blade supporting portion 16*b*, which is mounted to the supporting member 19 by the shoulder screw (fixing member) 17. In the gap between the head portion of the shoulder screw 17 and the blade supporting member 16*b*, there is interposed the spring washer (wave washer) 18 as a cushion member. The spring washer 18 is deformed to urge the blade member. That is, in this embodiment, the spring washer 18 is provided on the side opposite to the intermediate transfer belt 2 with respect to the blade supporting portion 16*b*. As shown in FIG. 2, the blade supporting portion 16*b* is arranged within the range of the acute inclination angle θ of the cleaning blade portion 16*a*.

Incidentally, the blade cleaning system has a problem in that due to a deterioration in the lubrication performance by the lubricant agent such as toner in the vicinity of the forward end of the cleaning blade and an increase in the frictional force between the cleaning blade and the intermediate transfer belt, there is generated a phenomenon in which the forward end portion of the cleaning blade is drawn-in in the rotating direction of the tension roller, and a load larger than that on the other contact surface is concentrated on a part of the portion drawn-in, with the result that the frictional force in that portion further increases, which leads to occurrence of a wire edge phenomenon to the cleaning blade.

In this regard, this embodiment adopts the above-described construction, in which the blade supporting portion 16*b* is in intimate contact with the supporting member 19, so that no gap is generated between them. Even when the pressurizing force applied to the intermediate transfer belt 2 increases as a result of the forward end portion of the cleaning blade portion 16*a* being partially or entirely drawn-in, the blade supporting portion 16*b* is regulated in its movement in the direction indicated by the arrow B to promote a wire edge phenomenon in the blade portion 16*a*. Thus, occurrence of a wire edge phenomenon to the blade portion 16*a* is suppressed, making it possible for the blade member 16 to maintain a satisfactory cleaning performance in a stable manner.

What has been described above has been confirmed through comparison with a conventional example in which, as shown in FIG. 3, the spring washer 18 is provided on the intermediate transfer belt 2 side with respect to the blade supporting portion 16*b*. FIG. 4 shows the results of measurement of changes in the amount of deflection of the blade portion 16*a* with time in this embodiment shown in FIG. 2 and in the comparative example shown in FIG. 3. In the construction of the comparative example shown in FIG. 3, a gap is formed between the head portion of the shoulder screw 17 and the blade supporting portion 16*b*, so that, when the pressurizing force applied to the intermediate transfer belt 2 increases as a result of the forward end portion of the blade portion 16*a* being partially or entirely drawn in, the blade supporting portion 16*b* moves in the direction indicated by the arrow B to promote occurrence of a wire edge phenomenon to the blade portion 16*a*. Accordingly, the amount of deflection of the blade portion 16*a* increases, which leads to occurrence of a wire edge phenomenon to the same.

FIG. 4 shows the amount by which the blade portion 16*a* is deflected as shown in FIG. 5 when the blade portion 16*a* is caused to abut the tension roller 2*c* with a predetermined abutment pressure. When the amount of strain shown in FIG. 4 is positive, the blade portion 16*a* is deflected as shown in FIG. 5. The results given in FIG. 4 show how the forward end portion of the blade portion 16*a*, which abuts the tension roller 2*c* as shown in FIG. 5, is gradually drawn-in in the rotating direction of the tension roller 2*c*. It can be seen from the results shown in FIG. 4 that, in the construction of the comparative example, the amount of deflection of the blade portion 16*a* gradually decreases with the passage of time until a wire edge phenomenon occurs, whereas, in the construction of this embodiment, the amount of deflection of the blade portion 16*a* does not decrease with the passage of time unlike in the conventional construction, and a stable condition is maintained, involving no occurrence of a wire edge phenomenon.

Figure 6:
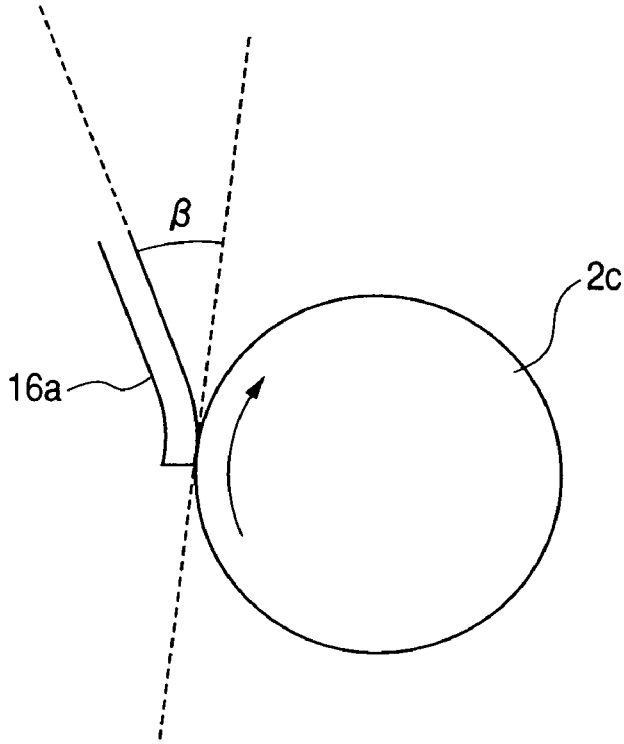
FIG. 6 is a diagram showing how a portion near an abutting portion of the cleaning blade is changed.

This indicates that, in a state in which the blade portion 16*a* is caused to abut the tension roller 2*c* as shown in FIG. 6, the forward end portion of the blade portion 16*a* does not abut the tension roller 2*c* with its edge but abuts it in a stable state. In FIG. 6, symbol β indicates the angle at which the blade portion 16*a* abuts the tension roller 2*c*.

Figure 7:
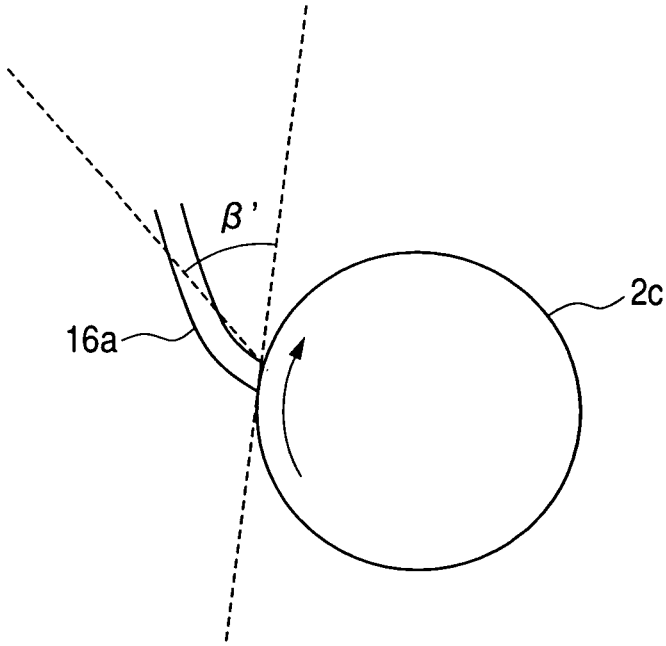
FIG. 7 is a diagram showing how a portion near the abutting portion of the cleaning blade is changed.

However, when, as shown in FIG. 7, the forward end portion of the blade portion 16*a* is partially or entirely drawn in, the abutment angle β' of the blade portion 16*a* (the angle the blade portion 16*a* makes with the tangent at its abutment point on the tension roller 2*c*) is larger than the abutment angle β shown in FIG. 6 (β'>β), so that the abutment pressure at the position where the cleaning blade portion 16*a* abuts the tension roller 2*c* increases.

Figure 8:
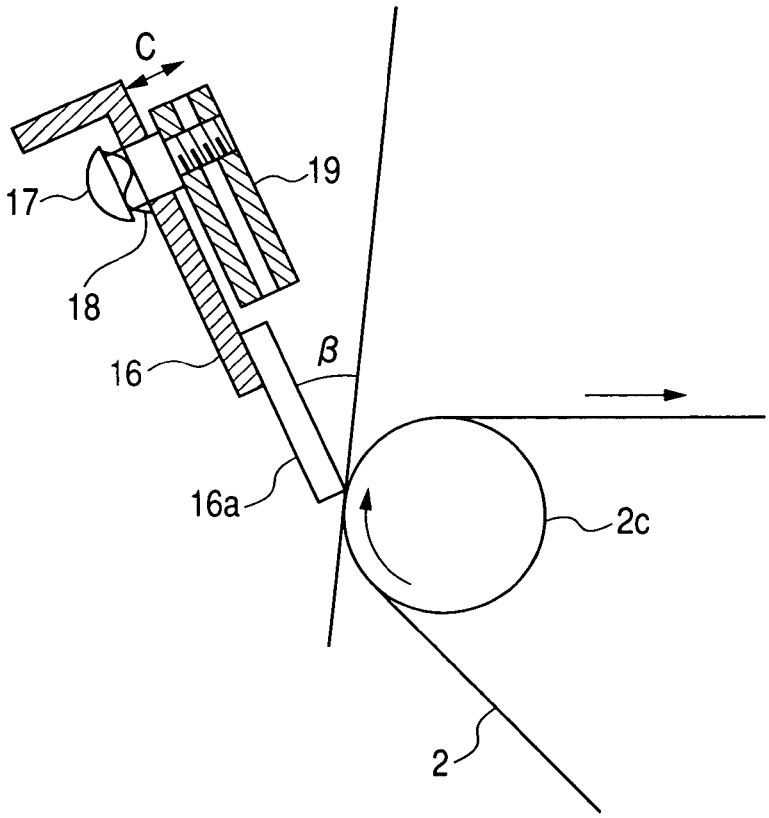
FIG. 8 is a diagram illustrating the operation of the cleaning blade of the cleaning device of Embodiment 1 of the present invention.

In this embodiment, the spring washer 18 as a cushion member is provided between the head portion of the screw 17 and the blade supporting portion 16*b*, so that, when the forward end portion of the blade portion 16*a* is brought into the state as shown in FIG. 7, the blade portion 16*a* can, as shown in FIG. 8, make fine movements in the direction indicated by the arrows C to a degree that the blade portion 16*a* does not affect the abutment pressure and the abutment angle β. Thus, the blade portion 16*a* is not easily brought into the state as shown in FIG. 7, which is more advantageous than the comparative example in terms of occurrence of a wire edge phenomenon, making it possible to maintain a satisfactory cleaning performance in a stable manner.

Embodiment 2

Figure 9:
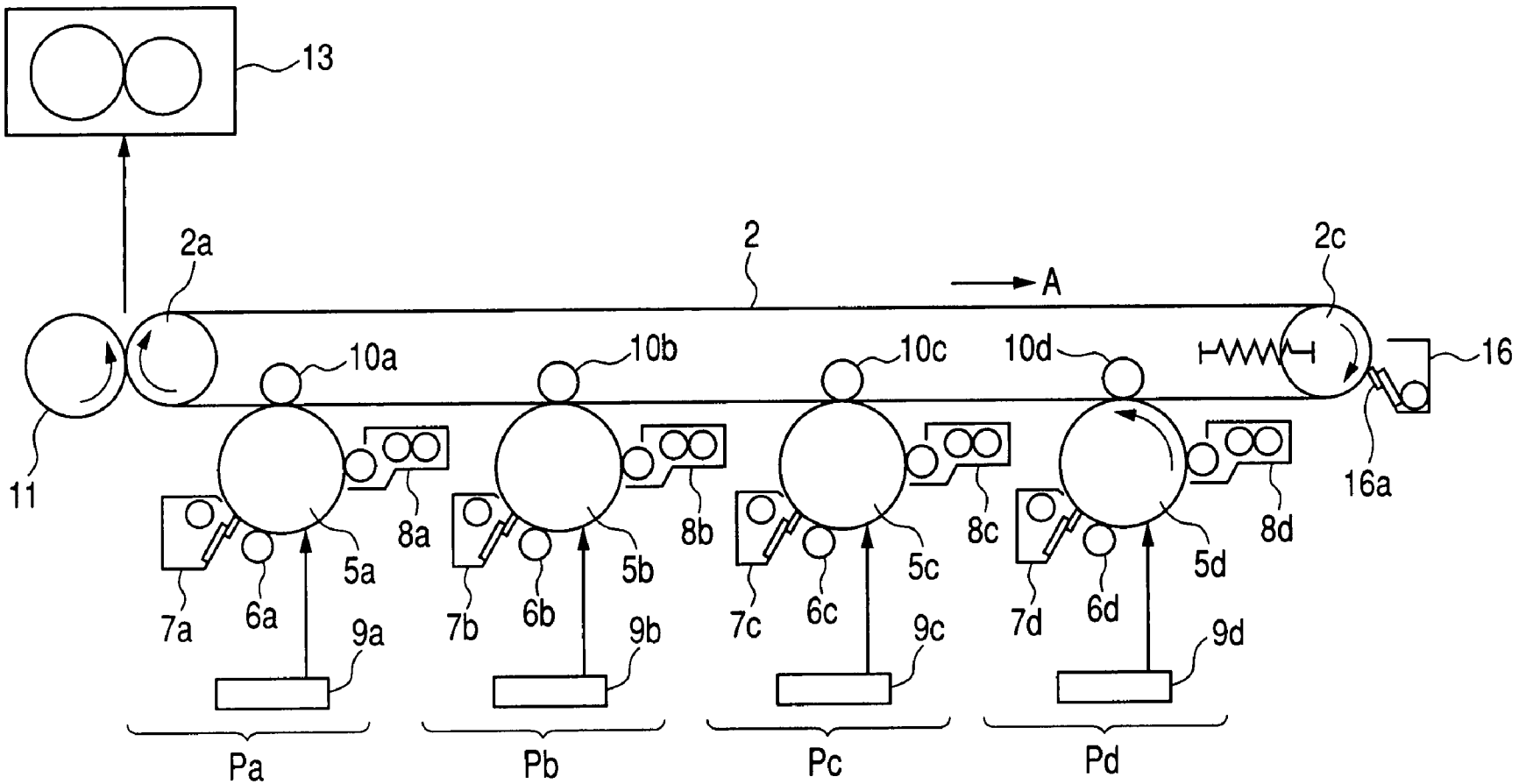
FIG. 9 is a schematic view showing a general construction of an image forming apparatus according to Embodiment 2 of the present invention.
Figure 10:
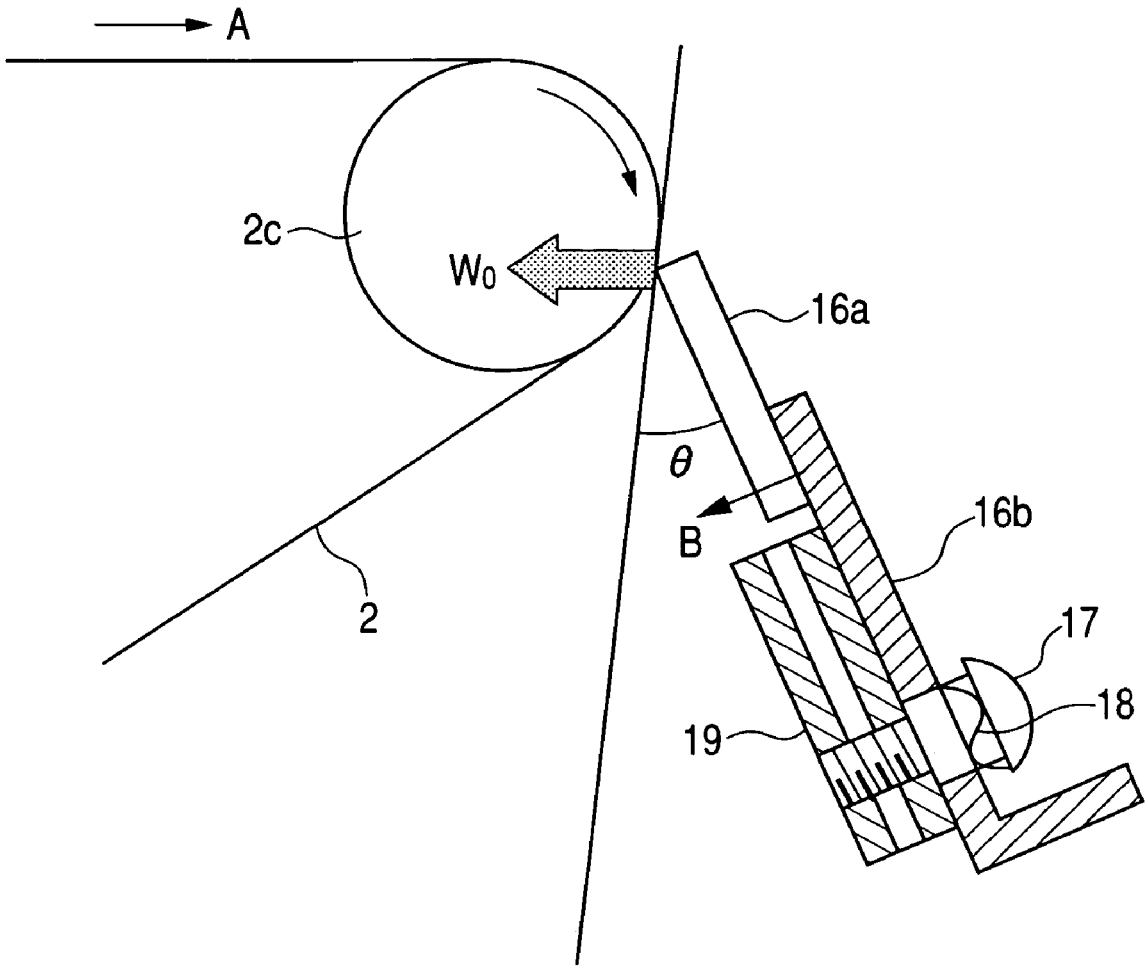
FIG. 10 is a diagram showing the construction of a cleaning device according to Embodiment 2 of the present invention.

Next, Embodiment 2 of the present invention will be described with reference to FIGS. 9 and 10. FIG. 9 is a diagram showing the general construction of an image forming apparatus, and FIG. 10 is a diagram showing the construction of a cleaning device (the blade member 16, the shoulder screw 17, the spring washer 18, and the supporting member 19) according to this embodiment.

The image forming apparatus of this embodiment is also a four-color/full-color image forming apparatus adopting the electrophotographic printing method, and adapted to form a full color image on a recording material by using a plurality of photosensitive drums 5 (5*a*, 5*b*, 5*c*, and 5*d*) serving as the image bearing members.

In this image forming apparatus also, four image forming portions Pa, Pb, Pc, and Pd of the same construction are arranged in series. For example, in the image forming portion Pa, processing devices, such as the primary charger 6*a*, the developing device 7*a*, and the cleaner 8*a*, are arranged around the photosensitive drum 5*a*. The other image forming portions Pb, Pc, and Pd are of the same construction as the image forming portion Pa, and processing devices, such as the primary chargers 6*b*, 6*c*, and 6*d*, the developing devices 7*b*, 7*c*, and 7*d*, and the cleaners 8*b*, 8*c*, and 8*d*, are respectively arranged around the photosensitive drums 5*b*, 5*c*, and 5*d*.

In this embodiment, the intermediate transfer belt 2 in the form of an endless belt is arranged above the image forming portions Pa through Pd. In the intermediate transfer belt 2, which is stretched between the driving roller 2*a* and the tension roller 2*c* and which runs in the direction indicated by the arrow A, the load is maximum in the portion thereof that is in contact with the photosensitive drums 5 (5*a* through 5*d*), so that the driving roller 2*a* is arranged on the downstream side of the portion in contact with the photosensitive drums 5 (5*a* through 5*d*). Thus, the tension roller 2*c* is arranged on the upstream side of the portion in contact with the photosensitive drums 5 (5*a* through 5*d*), and the blade member 16 for cleaning the intermediate transfer belt 2 is arranged so as to be opposed to and in contact with the tension roller 2*c*. In FIG. 9, reference numeral 11 indicates the secondary transfer roller, and reference numeral 13 indicates the fixing portion.

Here, the construction of the blade member 16 will be described in detail with reference to FIG. 10.

In the blade member 16, the blade portion 16*a*, which is formed of an elastic material, abuts the tension roller 2*c* through the intermediation of the intermediate transfer belt 2, with its forward end portion being inclined by an inclination angle θ so as to be at an acute angle on the downstream side with respect to the running direction (indicated by the arrow A) of the intermediate transfer belt 2. The blade portion 16*a* is pressurized against the tension roller 2*c* by urging means (not shown).

The blade portion 16*a* is rotatably supported substantially at the central portion with respect to the width direction of the intermediate transfer belt 2, and has an equalizing mechanism. Further, the blade portion 16*a* is arranged such that its forward end portion faces upwards. Further, the blade supporting portion 16*b* supporting the blade portion 16*a* is supported so as to be rotatable with respect to the supporting member 19 by the shoulder screw 17.

The blade portion 16*a* is mounted to an end portion of the blade supporting portion 16*b*, which is mounted to the supporting member 19 by the shoulder screw 17 (fixing member). In the gap between the head portion of the shoulder screw 17 and the blade supporting member 16*b*, there is provided the spring washer (wave washer) 18. As in Embodiment 1, the spring washer 18, serving as the cushion member, is provided on the side opposite to the intermediate transfer belt 2 with respect to the blade supporting portion 16*b*.

Thus, in this embodiment also, the blade supporting portion 16*b* is in intimate contact with the supporting member 19, so that no gap is generated between them. Even when the pressurizing force applied to the intermediate transfer belt 2 increases as a result of the forward end portion of the cleaning blade portion 16*a* being partially or entirely drawn in, the blade supporting portion 16*b* is regulated in its movement in the direction indicated by the arrow B in FIG. 10 which promotes a wire edge phenomenon in the blade portion 16*a*. Thus, occurrence of a wire edge phenomenon to the blade portion 16*a* is suppressed, making it possible for the blade member 16 to maintain a satisfactory cleaning performance in a stable manner.

While in Embodiments 1 and 2 described above the blade portion 16*a* is formed of an elastic material, the above-mentioned effect of the present invention can also be obtained when the cleaning blade portion 16*a* is formed of a rigid material.

This application claims priority from Japanese Patent Application No. 2004-294622 filed Oct. 7, 2004, which is hereby incorporated by reference herein.

What is claimed is:

1. An image forming apparatus comprising:

a belt member, which moves while bearing a toner image;

a tension roller, which supports the belt member and imparting tension to the belt member;

transferring means for transferring the toner image borne by the belt member to a recording material;

a blade member, which is in contact with a portion of the belt member supported by the tension roller to be at an acute angle on a downstream side with respect to a moving direction of the belt member, and which removes toner from the belt member;

a supporting member, which supports the blade member;

a fixing member, which supports on the supporting member a substantial central portion of the blade member in a direction perpendicular to the moving direction of the belt member so that the blade member is rotatable; and a cushion member, which is disposed between the fixing member and the blade member and which is deformed to urge the blade member, wherein the cushion member is disposed on a side opposite to the belt member with respect to the blade member.

2. An image forming apparatus according to claim 1, wherein the blade member is held in contact with the belt member with a predetermined pressure by urging means.

3. An image forming apparatus according claim 1 or 2, wherein the blade member is arranged so that a forward end portion of the blade member is directed vertically upwards.

* * * * *

UNITED STATES PATENT AND TRADEMARK OFFICE

CERTIFICATE OF CORRECTION

PATENT NO. : 7,254,356 B2
APPLICATION NO. : 11/228318
DATED : August 7, 2007
INVENTOR(S) : Jun Tomine et al.

It is certified that error appears in the above-identified patent and that said Letters Patent is hereby corrected as shown below:

COLUMN 10:

Line 5, "imparting" should read --imparts--.

Signed and Sealed this

Twenty Second Day of April, 2008

JON W. DUDAS
*Director of the United States Patent and Trademark Office*